US008265516B2

(12) United States Patent
Ito

(10) Patent No.: US 8,265,516 B2
(45) Date of Patent: Sep. 11, 2012

(54) BELT UNIT, TRANSFER UNIT AND IMAGE FORMING APPARATUS

(75) Inventor: Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 450 days.

(21) Appl. No.: 12/453,915

(22) Filed: May 27, 2009

(65) Prior Publication Data

US 2009/0324277 A1 Dec. 31, 2009

(30) Foreign Application Priority Data

Jun. 26, 2008 (JP) ..... 2008-167283

(51) Int. Cl.
*G03G 15/16* (2006.01)

(52) U.S. Cl. ..... 399/101; 399/121

(58) Field of Classification Search ..... 399/101, 399/121, 162–165, 302–308, 313; 156/294
See application file for complete search history.

(56) References Cited

U.S. PATENT DOCUMENTS

| | | | | |
|---|---|---|---|---|
| 7,068,952 | B2 * | 6/2006 | Tamaoki | 399/2 |
| 7,953,356 | B2 * | 5/2011 | Ito | 399/303 |
| 2006/0083558 | A1 * | 4/2006 | Tomizawa | 399/302 |
| 2007/0181251 | A1 * | 8/2007 | Ikeda et al. | 156/294 |

FOREIGN PATENT DOCUMENTS

| | | |
|---|---|---|
| JP | 2006-231689 | 9/2006 |
| JP | 2007-121619 | 5/2007 |
| JP | 2008-009287 | 1/2008 |
| JP | 2008-83337 | 4/2008 |
| JP | 2008-122446 | 5/2008 |

* cited by examiner

*Primary Examiner* — Hoan Tran
(74) *Attorney, Agent, or Firm* — Rabin & Berdo, P.C.

(57) ABSTRACT

A belt unit includes an endless belt that transports a recording medium thereon. The endless belt has a Young's modulus in the range of $3.5 \leqq Y \leqq 7.0$. The endless belt is disposed about a plurality of rollers, and runs about the rollers. The endless belt has a thickness such that $0.0025 \leqq Y \times T^3 \leqq 0.007$ where Y is the Young's modulus and T is the thickness. A cleaning member removes deposits from the surface of the endless belt. The belt unit may also operate as a transfer unit and include a cleaning member disposed about a plurality of rollers. The cleaning member removes deposits from the surface of the endless belt. An image forming apparatus may include the belt unit or transfer unit.

15 Claims, 3 Drawing Sheets

BELT UNIT, TRANSFER UNIT AND IMAGE FORMING APPARATUS

BACKGROUND OF THE INVENTION

1. Field of the Invention

The present invention relates to a belt unit and a transfer unit that include an endless belt, and to an image forming apparatus that incorporates the belt unit or the transfer unit.

2. Description of the Related Art

Among conventional belt units is one that employs a belt formed of a resin having a Young's modulus of 2000 MPa or higher for durability. For example, JP 2008-9287 discloses one such belt unit. Conventional belt units do not provide sufficiently long useable life. The embodiments of the invention are effective in increasing the quality of image.

SUMMARY OF THE INVENTION

An object of embodiments of the invention is to increase the life of a belt.

The present invention improves the durability of a belt unit.

A belt unit includes an endless belt that transports a recording medium thereon. The endless belt has a Young's modulus in the range of $3.5 \leqq Y \leqq 7.0$. The endless belt is disposed about a plurality of rollers, and runs. A cleaning member removes foreign matter deposited on the surface of the endless belt. The endless belt has a thickness such that $0.0025 \leqq Y \times T^3 \leqq 0.007$ where Y is the Young's modulus and T is the thickness in millimeters.

A transfer unit includes an endless belt having a Young's modulus in the range of $3.5 \leqq Y \leqq 7.0$ where Y is Young's modulus in gigapascals (Gpa). The endless belt is disposed about at least two rollers, and runs. A transfer member positioned between the at least two rollers. A cleaning member is disposed about a plurality of rollers, and runs. The cleaning member removes deposits from the surface of the endless belt.

An image forming apparatus includes an endless belt having a Young's modulus in the range of $3.5 \leqq Y \leqq 7.0$ where Y is Young's modulus in gigapascals. The endless belt is disposed about at least two rollers, and runs. A transfer member is positioned between the at least two rollers. A cleaning member removes deposits from the surface of the endless belt.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
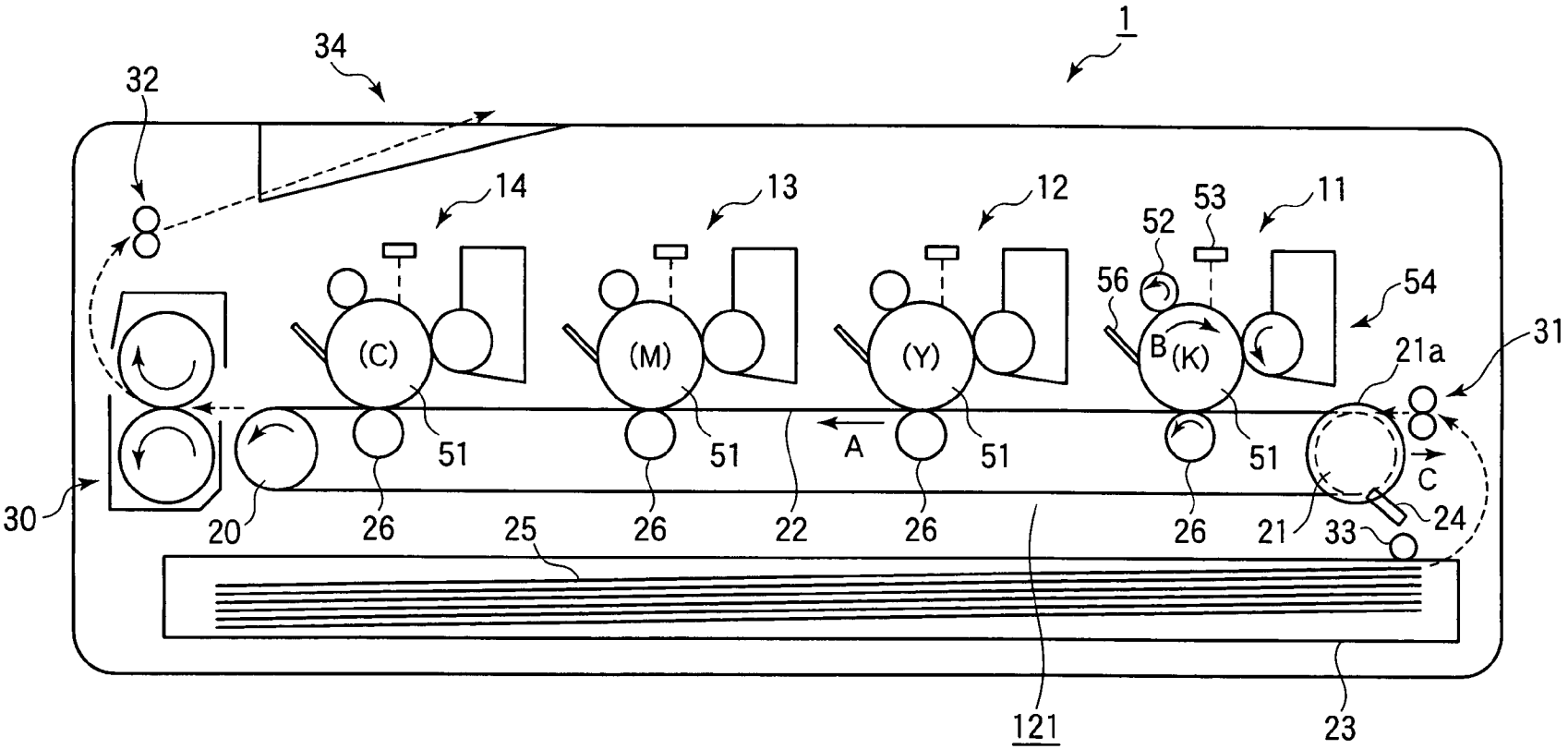
FIG. 1 illustrates a pertinent portion of an image forming apparatus of a first embodiment that employs a belt unit of the invention.

FIG. 1 illustrates a pertinent portion of an image forming apparatus 1 of a first embodiment that employs a belt unit 121 of the invention.

Referring to FIG. 1, the image forming apparatus 1 is a direct transfer electrophotographic color printer of a tandem type. A paper cassette 23 holds a stack of recording media or recording paper 25. A feed roller 33 feeds the top page of the stack of the recording paper 25 into a transport path shown in dotted line. A transport roller 31 is disposed downstream of the transport path and transports the recording paper 25 to print engines 11-14. The print engines 11-14 are aligned in this order from upstream to downstream with respect to direction of travel of the recording paper 25 along a belt unit 121, and form a black (K) image, a yellow (Y) image, a magenta (M) image, and a cyan (C) image), respectively. The print engines 11-14 are substantially identical in configuration, and differ only in the color of toner.

For example, the print engine 11 forms a black image and includes a photoconductive drum 51, a charging station or a roller 52, an exposing station 53, a developing station 54, and a cleaning member or a cleaning blade 56. The charging station 52 uniformly charges the circumferential surface of the photoconductive drum 51. The exposing station 53 irradiates the charged surface of the photoconductive drum 51 with light according to print data. The developing station 54 develops the electrostatic latent image with the toner into a toner image. The cleaning blade 56 scrapes the circumferential surface of the photoconductive drum 51 to remove the toner remaining on the photoconductive drum 51 after transfer of the toner image.

The belt unit 121 may include an endless belt 22, a drive roller 20, a tension roller 21, and a cleaning blade 24, and may serve as a transfer unit as well. The endless belt 22 supports the recording paper 25 thereon, and passes through the print engines 11-14. The endless belt 22 is disposed about the drive roller 20 and the tension roller 21 such that when the drive roller 20 is driven in rotation by a drive source (not shown), the endless belt 22 runs in a direction shown by arrow A. The cleaning blade 24 scrapes the surface of the endless belt 22 to remove residual toner adhering to the endless belt 22, thereby cleaning the endless belt 22 after transferring. A transfer member or a transfer roller 26 is disposed at a position where the transfer roller 26 faces the photoconductive drum 51 and the endless belt 22 is sandwiched between the transfer roller 26 and the photoconductive drum 51. When the recording paper 25 enters a transfer point defined between the photoconductive drum 51 and the endless belt 22, a corresponding toner image is transferred onto the recording paper 25.

As the recording paper 25 having the toner image thereon passes through a fixing point defined between a heat roller and a pressure roller of a fixing unit 30, the toner image is fused by heat and pressure into a permanent image. After fixing, a transport roller 32 transports the recording paper 25 to a stacker 34 where a stack of printed recording paper 25 is supported.

Figure 2A:
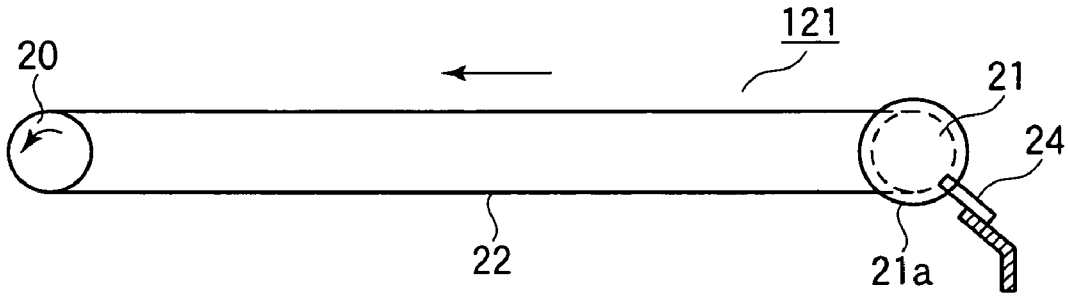
FIG. 2A illustrates the belt unit.

The tension roller 21 includes an urging means (not shown) to apply a tensile force of 6±10% kg to the endless belt 22. The tension roller 21 also includes a flange-shaped guide 21*a* (FIG. 2A) attached thereto that prevents the endless belt 22 from running crooked. The guide 21*a* may be provided in the vicinity of one widthwise end of the endless belt 22, or may be provided in the vicinity of both widthwise ends of the endless belt 22. The guide 21*a* may be driven independently of the endless belt 22 or may be driven by the endless belt 22. The guide 21*a* may be mounted to other structural elements (e.g., the drive roller 20) than the tension roller 21.

{Operation of Image Forming Apparatus}

The operation of the image forming apparatus 1 of the aforementioned configuration will be described with reference to FIG. 1.

A power supply (not shown) applies a high voltage to the charging station 52 such that the charging station 52 charges the circumferential surface of the photoconductive drum 51. As the photoconductive drum 51 rotates in a direction shown by arrow B, the charged surface passes an area directly under the exposing station 53. The exposing station 53 irradiates the charged surface of the photoconductive drum 51 according to print data to form an electrostatic latent image. As the photoconductive drum 51 further rotates in the B direction, the electrostatic latent image is brought into contact with the developing station 54 where the electrostatic latent image is developed with the toner into a toner image.

The feed roller 33 feeds the top page of the stack of the recording paper 25 toward the print engine 11. The recording paper 25 is transported by the transport roller 31 and the endless belt 22 to the transfer point defined between the photoconductive drum 51 and the transfer roller 26. The photoconductive drum 51 rotates such that the toner image on the photoconductive drum 51 is transferred onto the recording paper 25 carried on the endless belt 22. As the recording paper 25 passes through the print engines 11-14 for black (K), yellow (Y), magenta (M), and cyan (C) in sequence, the toner images of corresponding colors are transferred onto the recording paper 25 one over the other in registration to form a full color toner image.

The endless belt 22 further transports the recording paper 25 having the full color toner image thereon and feeds the recording paper 25 into the fixing unit 30 where the full color toner image is fused by heat and pressure into a permanent full color image. The recording paper 25 is finally discharged by the transport roller 32 onto the stacker 34. This completes the image forming operation. During the operation, the cleaning blade 24 removes the residual toner and deposit or foreign matter adhering to the endless belt 22.

{Endless Belt}

The endless belt 22 will be described in detail.

The endless belt 22 is manufactured as follows: A variety of polyamide-imides (PAIs) may be carefully selected in terms of types of monomers that constitute the polyamidimide, the proportions of monomers, and molecular weight of monomers. A high molecular compound of polyamideimide may be selected from among a variety of polyamideimides (PAIs) and may be mixed with carbon black for rendering the material electrically conductive. Then the mixture is further mixed by agitating in a solution of N-methyl-2-pyrrolidone (NMP). Finally, the mixture is charged into a mold, thereby forming a belt having a thickness of 100±10 μm and a peripheral length of 624±1.5 mm by rotational molding. Subsequently, the shaped material is cut into a size of 228±0.5 mm.

PAI has a series of a chemical structure in which an amide group is linked to one or two imide groups via an organic group. PAI is either aliphatic PAI or aromatic PAI depending on whether the organic group is aliphatic or aromatic. The endless belt 22 may be preferably formed of aromatic PAI from a point of view of durability and mechanical characteristics. The aromatic series used in the present invention such that an organic group linking an imide group to an amide group takes the form of one or two benzene rings. PAI may be in a state of a complete imide ring-closure or in a state of amide acid that is still at a stage of an imide ring-closure. If PAI contains amide acid, at least more than 50%, preferably more than 70%, of the PAI should be imidized. This is because incorporation of a large percentage of amide acid causes large dimension errors.

Generally speaking, the use of a material having a molecular structure containing a large percentage of aromatic ring or imide group increases the Young's modulus of the endless belt. Conversely, the use of a material having a molecular structure containing a small percentage of aromatic ring or imide group decreases the Young's modulus of the endless belt.

When the endless belt is manufactured by using a rotational molding, the solvent maybe selected as appropriate. An organic solvent is commonly used. Useful solvents include N,N-dimethylformamides, N,N-dimethylacetamides, N,N-diethylformamide, N,N-diethylacetamides, Dimethyl sulfoxide, NMP, pyridine, tetramethylene sulfone, and dimethyltetramethylene sulfone. N,N-dimethylacetamides is particularly useful. These solvents may be used alone or in combination. The aforementioned solvents may also be used when the belt is made with a cylindrical mold. No solvent is required for a belt manufactured by an extrusion molding method.

Carbon black in a proper amount added to the belt material includes furnace black, channel black, ketjen black, and acetylene black. These materials may be used alone or in combination. Any of these materials may be employed depending on the required electrical conductivity. Furnace black and channel black are preferably used for the endless belt of the invention. Furnace black and channel black may be preferably undergone antioxidant treatment such as oxidation treatment or may preferably have improved dispersion into the solvent. The amount of carbon black may be selected depending on the types of carbon black for specific purpose. The endless belt of the invention contains carbon black in an amount of 3-40 wt % and more preferably 3-30 wt % for sufficient mechanical strength.

The toner used in the image forming apparatus 1 contains a toner release agent or paraffin wax in an amount of 9 weight parts based on 100 weight parts of styrene acrylic copolymer. The paraffin wax is internally added to the toner by emulsion polymerization method. The toner particles have an average diameter of 7 μm and a sphericity of 0.95. This toner does not require application of oil to the heat roller and pressure roller of the fixing unit for preventing toner deposition on the rollers, is excellent in transfer efficiency, dots reproducibility, and resolution of printed images, providing sharp images and high quality images.

The cleaning blade 24 (FIG. 1) is formed of urethane rubber and has a rubber hardness of 83° (JIS A) and a thickness of 1.5 mm. The cleaning blade 24 applies a line pressure of 4.3 g/mm on the belt. A blade formed of an elastic material such as urethane rubber is excellent in removing residual toner and foreign matter from the belt 10, and is of simple structure, which implements a compact, low cost blade. Urethane is employed for its high hardness, elasticity, wear-resistance, mechanical strength, oil-resistance, and ozone-resistance. Ozone-resistance prevents deterioration of urethane.

The drive roller 20 and tension roller 21 have a diameter of 25 mm. However, the diameter is not limited to 25 mm. Actually, a diameter in the range of 10 to 50 mm is commonly employed for implementing a low cost and small size image forming apparatus.

The endless belt 22 is looped on the drive roller 20 and tension roller 21. The tension roller 21 is urged by an urging means, e.g., spring (not shown) in a direction shown by arrow C. The tension is 6±0.6 kg. However, the belt may be looped on the rollers 20 and 21 in different ways. The tension may be selected depending on the material of the belt and a belt driving means, and is usually in the range of 1.8-8.8 kg.

A plurality of endless belts formed of PAI were prepared which differ in Young's modulus, and were subjected to an endurance test. The test results will be described as follows:

The endurance tests were performed under the following conditions.

(1) The endless belt is incorporated in the belt unit 121 assembled in the MODEL C5800 OKI printer.

(2) A print pattern of horizontal lines of black (K), yellow (Y), magenta (M), and cyan (C) are printed at a density of 0.5% on A4 size paper. Here, density is a ratio of a printed area on a print medium to a printable area on the print medium.

(3) Printing is performed by repeating a cycle of 3-min. printing and 7-sec. rest.

(4) The Young's modulus is measured in accordance with JIS K7127.

(5) The belt unit 121 was tested in an environment of, for example, 23±3° C. and 55±10% RH.

(6) The endless belt runs at a circumferential speed of 89 mm/sec.

(7) The endless belt has a thickness of 100±8 μm.

Table 1 lists the results of the endurance test. Symbol "YES" in "Durability" indicates that no turning-up of the belt was observed until the number of printed pages shown is reached. Symbol "NO" in "Durability" indicates that turning-up of the belt was observed at the number of printed pages shown.

TABLE 1

| Comparison and Example | Young's modulus (GPa) | Blade Failure (Number of printed pages) | Durability |
|---|---|---|---|
| COMP #1 | 3.0 | blade turned up at 50K | NO |
| EXMPL #1 | 3.5 | OK at 80K | YES |
| EXMPL #2 | 4.0 | OK at 80K | YES |
| EXMPL #3 | 4.5 | OK at 80K | YES |
| EXMPL #4 | 5.0 | OK at 80K | YES |
| EXMPL #5 | 5.5 | OK at 80K | YES |
| EXMPL #6 | 6.0 | OK at 80K | YES |
| EXMPL #7 | 6.5 | OK at 80K | YES |
| EXMPL #8 | 7.0 | OK at 80K | YES |

As is clear from Table 1, for COMPARISON #1 having a Young's modulus of 3.0 gigapascals (referred to as GPa hereinafter), turning-up of the cleaning blade 24 occurs after the number of printed pages has reached 50K. For EXAMPLEs 1 to 8, no turning-up of the cleaning blade 24 occurred up to the number of printed pages exceeds 80K above which the cleaning blade 24 is believed to have sufficient durability. This implies that the endless belt 22 should have a Young's modulus in the range of 3.5 to 7.0 GPa in order to prevent the cleaning blade 24 from turning up. The test results and evaluation of the test results will be described with reference to FIG. 2.

Figure 2B:
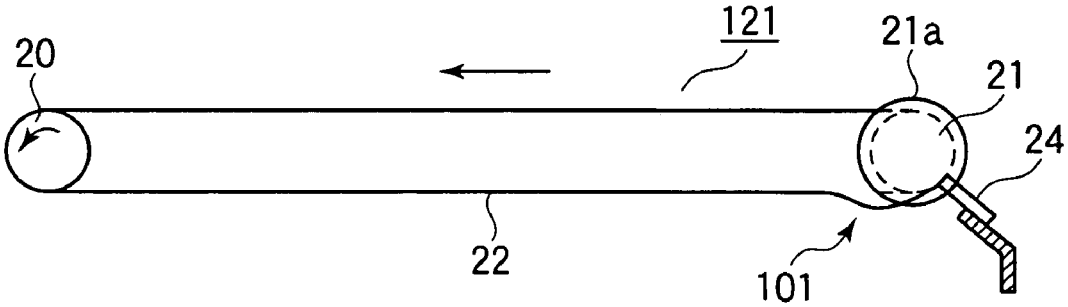
FIG. 2B illustrates the belt unit when a slack is developed.

Generally, as the cumulative number of printed pages increases, residual toner and foreign matter deposited on the endless belt cause filming on the surface of the endless belt, the filming being in intimate contact. The filming on the surface of the endless belt enhances the intimate contact and affinity between the cleaning blade 24 and the endless belt 22, increasing the friction between the cleaning blade 24 and the endless belt 22. The increase in frictional causes an increase in shearing stress between the surface of endless belt 22 and the cleaning blade 24. At this moment, the cleaning blade 24 applies braking force to the belt, causing local chipping and turning up of the cleaning blade at its edge. A low Young's modulus of the endless belt 22 may cause a slack 101 to appear immediately upstream of the cleaning blade 24 as shown in FIG. 2(*b*). The slack 101 may enter a blade nip formed between the cleaning blade 24 and the endless belt 22 to push up the blade 24, causing the turning up of the cleaning blade 24.

In other words, the endless belt 22 having a high Young's modulus prevents the cleaning blade 24 from turning up. As is clear from the test results shown in Table 1, a Young's modulus higher than 3.5 GPa is effective in reducing the chance of the cleaning blade 24 turning up during printing at least until the number of printed page reaches 80K. The endless belt 24 having a Young's modulus higher than 7.0 GPa is very difficult to implement in terms of technological feasibility, production facility, and production time, leading to high cost and yield loss of the endless belt, if ever possible. Thus, no evaluation was made for endless belts having a Young's modulus of 7.0 GPa or higher.

While the first embodiment has been described in terms of an endless belt formed of PAI, but the present invention is not limited to this. However, the belt is subjected to repetitive sliding engagement with a member that prevents the belt from running crooked. From points of view of durability and mechanical characteristics required of the endless belt, the endless belt should preferably be formed of a material that has a tensile deformation within a limited rage when the endless belt is driven to run and a material that is resistant to damage such as wear and kinking of the sides of the endless belt and cracking of the endless belt. The endless belt may also be formed of a material having a Young's modulus higher than 3.5 GPa. Such materials may be resin materials, and include polyimide (PI), polycarbonate (PC), polyamide (PA), polyetheretherketone (PEEK), polyvinylidene fluoride (PVDF) and ethylene-tetrofluoride ethylene copolymer (ETFE), and a mixture of any of these materials as a matrix and some additives.

As described above, a belt unit that employs an endless belt having a Young's modulus in the range of 3.5 to 7.0 GPa effectively prevents the cleaning blade from turning up, improving the durability and reliability of the belt unit as well as minimizing yield loss and the increase in manufacturing cost of the belt unit.

Second Embodiment

A second embodiment is directed to an endless belt having a thickness and a Young's modulus in predetermined ranges.

An endurance test of the second embodiment were performed by operating an image forming apparatus which is identical in configuration to the first embodiment. The tests were performed under the same conditions as the first embodiment except for the specific specimens of the endless belt. A description will be given only of portions different from the first embodiment.

Specimens of the endless belt having different combinations of thickness and Young's modulus were prepared for the endurance test.

The specimens of the endless belt were prepared by controlling the amount of PAI material cast into a mold. The thicknesses of resulting specimens were measured with a micrometer.

Tests were performed under the following conditions.

(1) The endless belts were incorporated in the belt unit 121 for the MODEL C5800 OKI printer.

(2) A print pattern of horizontal lines of black (K), yellow (Y), magenta (M), and cyan (C) were printed at a dot population density of 0.5% on A4 size paper.

(3) Printing was performed by repeating a cycle of 3-min. printing and 7-sec. rest.

(4) The Young's modulus is measured in accordance with JIS K7127.

(5) The tests were performed in an environment of, for example, 23±3° C. and 55±10% RH.

(6) The endless belt ran at a circumferential speed of 89 mm/sec.

Table 2 lists the results of the endurance test. Symbol "YES" in "Durability" indicates that no turning-up of the belt was observed until the number of printed pages exceeds 80K, above which the cleaning blade 24 is believed to have sufficient durability. Symbol "NO" in "Durability" indicates that the belt failed, e.g., fractured or broken apart completely or partially, and therefore the cleaning blade 24 is believed to have insufficient durability.

TABLE 2

| Comparisons and Examples | Young's Modulus (GPa) | Thickness (mm) | Coefficient, P | Blade Fracture (Number of Printed Pages | Durability |
|---|---|---|---|---|---|
| COMP #1 | 3.5 | 0.083 | 0.0020 | FRACTURED | NO |
| EXPL #1 | 3.5 | 0.089 | 0.0025 | GOOD at 80K | YES |
| EXPL #2 | 3.5 | 0.116 | 0.0055 | GOOD at 80K | YES |
| EXPL #3 | 3.5 | 0.126 | 0.0070 | GOOD at 80K | YES |
| COMP #2 | 3.5 | 0.130 | 0.0077 | FRACTURED | NO |
| EXPL #4 | 4.0 | 0.100 | 0.0040 | GOOD at 80K | YES |
| COMP #3 | 4.5 | 0.075 | 0.0019 | FRACTURED | NO |
| EXPL #6 | 4.5 | 0.116 | 0.0070 | GOOD at 80K | YES |
| EXPL #7 | 5.0 | 0.079 | 0.0025 | GOOD at 80K | YES |
| EXPL #7 | 5.0 | 0.098 | 0.0047 | GOOD at 80K | YES |
| EXPL #8 | 5.5 | 0.108 | 0.0069 | GOOD at 80K | YES |
| COMP #4 | 5.5 | 0.112 | 0.0077 | FRACTURED | NO |
| COMP #5 | 6.0 | 0.070 | 0.0021 | FRACTURED | NO |
| EXPL #9 | 6.0 | 0.075 | 0.0025 | GOOD at 80K | YES |
| EXPL #10 | 6.0 | 0.098 | 0.0056 | GOOD at 80K | YES |
| COMP #6 | 7.0 | 0.067 | 0.0021 | FRACTURED | NO |
| EXPL #11 | 7.0 | 0.071 | 0.0025 | GOOD at 80K | YES |
| EXPL #12 | 7.0 | 0.085 | 0.0043 | GOOD at 80K | YES |
| EXPL #13 | 7.0 | 0.100 | 0.0070 | GOOD at 80K | YES |
| COMP #7 | 7.0 | 0.102 | 0.0074 | FRACTURED | NO |

The coefficient P shown in Table 2 is given by $$P = Y \times T^3 \qquad \text{Eq. (1)}$$

where P is a coefficient, Y is the Young's modulus of the endless belt in GPa, T is the thickness of the belt in mm. EXAMPLEs #1 to #13 shown in Table 2 are endless belts of the invention and COMPARISONs #1 to #7 are not according to the present invention.

In the first embodiment, an endless belt should have a Young's modulus in the range of 3.5 to 7.0 GPa for the cleaning blade 24 to be free from turning-up of its edge. Table 2 reveals that an endless belt having a Young's modulus in the range of 3.5 to 7.0 GPa suffers from a drawback in that the endless belt may fracture depending on the thickness of the endless belt.

For example, EXAMPLEs #1-#3 and COMPARISONs #1-#2 have a Young's modulus of 3.5 GPa. However, EXAMPLEs #1, #2, and #3 having thicknesses of 0.089 mm, 0.116 mm, and 0.126 mm, respectively, are good enough in terms of durability. In contrast, COMPARISON #1 having a thickness of 0.083 mm and COMPARISON #2 having a thickness of 0.130 mm cause the endless belt to fracture before the number of printed pages reaches 80K. EXAMPLE #9 and COMPARISON #3 have a thickness of 0.075 mm. However, EXAMPLE #9 having a Young's modulus of 6.0 GPa exhibits good durability while COMPARISON #3 having a Young's modulus of 4.5 GPa fractures before the number of printed pages reaches 80K.

The inventor compared the durability of COMPARISONs #1 and EXAMPLEs #1-#3 having a Young's modulus of 3.5 GPa and COMPARISON #3 having a Young's modulus of 4.5 GPa with the durability of COMPARISONs #6 and #7 and EXAMPLEs #11-#13 having a Young's modulus of 7.0 GPa. It should be noted that the thickness of an endless belt having a higher Young's modulus of 7.0 lies in a lower range than the thickness of endless belts having a Young's modulus of 3.5 GPa, with portions of the two ranges overlapping each other. It is further to be noted that putting the values of belt thickness, at which the endless belt is believed to be sufficiently durable, into Equation (1) yields the values of the coefficient P lying substantially within the same range for those having different values of Young's modulus in the range of 3.5 to 7.0 GPa. In other words, the coefficient P is in the following range.

$$0.0025 < P < 0.007 \qquad \text{Eq. (2)}$$

Thus, if the Young's modulus Y and thickness T of an endless belt are related such that 0.0025<P<0.007, the cleaning blade 24 is prevented from turning up and the endless belt 22 is prevented from fracturing.

The values of coefficient P lower than 0.0025 exhibit poor cyclic fatigue resistance of the endless belt, and the endless belt reaches the end of its useable lifetime before the number of printed pages reaches a predetermined value, for example, 80K. A very sophisticated method is required for accurately casting a small amount of belt material uniformly into a mold. The values of coefficient P higher than 0.007 cause difficulties in manufacturing the endless belt, and require long production time as well. In addition, variations in the thickness of endless belt increase with increasing thickness of the endless belt. Such variations lead to inaccurate transporting performance of the belt. As a result, the cost of the endless belt will increase, and the resulting endless belt is not suitable to the image forming apparatus of the invention.

If the thickness of an endless belt increases, the thickness of the endless belt may vary depending on the locations on the endless belt. If the thickness varies depending on the locations on the endless belt, a very complex control apparatus may be required, in which case, the resulting endless belt is not suitable to the image forming apparatus of the invention. While the first and second embodiments have been described with respect to an endless belt made of PAI, the invention is not limited to these specific embodiments. From points of view of durability and mechanical characteristics required of an endless belt, the endless belt should preferably be formed of a material having a tensile deformation within a limited rage when the endless belt is driven to run. Such a material should be resistant to damage such as wear and kinking of the sides of the endless belt and cracking of the endless belt. The endless belt may also be formed of a material that satisfies Equation (2). Such materials may be resin materials including polyimide (PI), polycarbonate (PC), polyamide (PA), polyetheretherketone (PEEK), polyvinylidene fluoride (PVDF), and ethylene-tetrofluoride ethylene copolymer (ETFE), and a mixture of any of these materials as a matrix and some additives.

The drive roller 20 and tension roller 21 of the first and second embodiments have a diameter of 25 mm. However, the diameters of these rollers do not significantly affect the test results and may be in the range of 10 to 50 mm. The tension force applied to the endless belt 22 in the first and second embodiments was selected to be 6±10% kg. Too small a tension force fails to drive the endless belt accurately or causes the endless belt to wave. Too large a tension force exerts a large load on the belt, shortening the useful lifetime. The tension force should be in the range of 2±10% kg.

As described above, the endless belt has a Young's modulus and thickness given by equation (2), so that the belt is free from fracture and has excellent durability and reliability.

Third Embodiment

Figure 3:
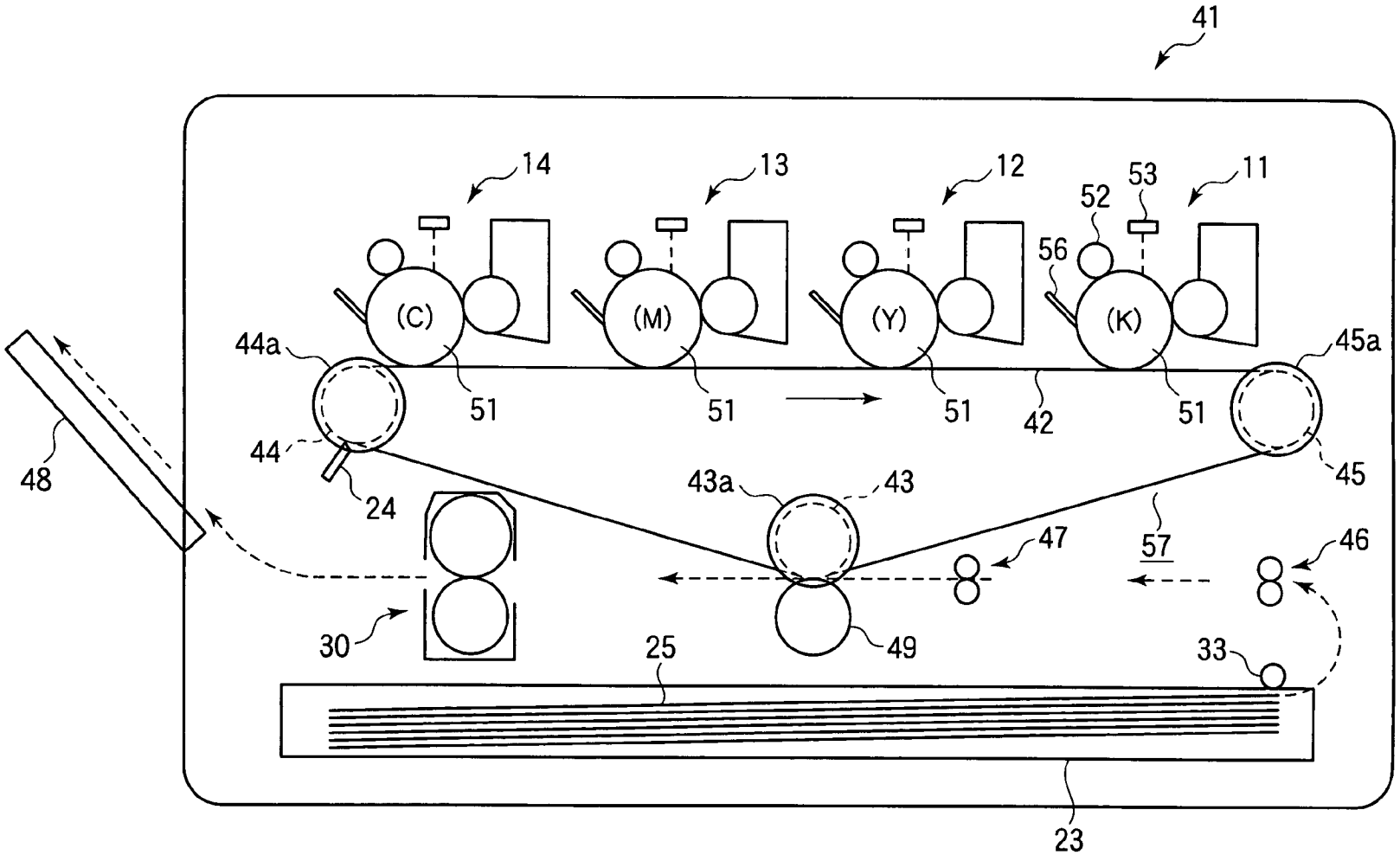
FIG. 3 illustrates a pertinent portion of an image forming apparatus of a third embodiment.

FIG. 3 illustrates a pertinent portion of an image forming apparatus 41 of a third embodiment.

The image forming apparatus of the third embodiment uses an intermediate transfer method. Elements similar to those of the first embodiment have been given the same reference numerals and their description is omitted.

The image forming apparatus 41 is configured as an electrophotographic printer that employs the intermediate transfer system. A paper cassette 23 holds a stack of recording medium or recording paper 25 therein. A feed roller 33 advances the top page of the stack of the recording paper 25 from the paper cassette 23. Transport rollers 46 and 47 transport the recording paper 25 to a transfer unit. Print engines 11-14 for forming cyan (C), magenta (M), yellow (Y), and black (k) toner images are aligned from upstream to downstream in a direction in which the endless belt 42 runs. A belt unit 57 may include an endless belt 42, support rollers 43-45, and a cleaning blade 24, and serves as a transfer unit as well. The endless belt 42 runs in contact with photoconductive drums 51 of the print engines 11-14. The print engines 11-14 are substantially identical in configuration, and differ only in the color of toner.

The endless belt 42 runs with a toner image thereon. Support rollers 43-45 are driven by a drive source (not shown) to drive the endless belt 42 to run. A cleaning blade 24 removes the toner adhering to the endless belt 42. A transfer roller 49 parallels the support roller 43 such that the endless belt 42 is sandwiched between the transfer roller 49 and the support roller 43.

It is preferable that the support rollers 43-45 include flange-shaped guides 43*a*-45*a*, respectively, for preventing the endless belt 42 from running crooked. The guides 43*a*-45*a* may be attached to both longitudinal ends of the support rollers 43-45 or may be attached to one longitudinal ends thereof. The guides 43*a*-45*a* may be driven independently of the endless belt 42 or may be driven by the endless belt 42. The guide 21*a* may be mounted to other structural elements than the support rollers 43-45.

The operation of the image forming apparatus 41 of the aforementioned configuration will be described with reference to FIG. 3. The recording paper 25 advances in a direction of dotted arrows. An electrostatic latent image is formed on the circumferential surface of the photoconductive drum 51 of each print engine. The electrostatic latent image is then developed with toner of a corresponding color into a toner image. The toner images, i.e., cyan (C), magenta (m), yellow (Y) and black (K) toner images on the respective photoconductive drums of the print engines are transferred onto the endless belt 42 one over the other in registration, The recording paper 25 is advanced by a feed roller 33 from the paper cassette 23 in timed relation with the formation of the toner image on the endless belt 42. The recording paper 25 enters a transfer point defined between the transfer roller 49 and the endless belt 42. When the recording paper 25 passes through the transfer point, the toner image is transferred onto the recording paper 25 by the transfer roller 49 to which a high voltage has been applied by a high voltage power supply (not shown)

Subsequently, the recording paper 25 having the toner images of corresponding colors thereon is transported by a transporting means (not shown) to a fixing unit 30. The toner images on the recording paper 25 are fixed on the recording paper 25 by heat and pressure into a full color permanent image. Then, the recording paper 25 is discharged by a discharging means onto a stacker 48. This completes the printing operation of the printer. After the recording paper 25 has left the endless belt 42, the cleaning blade 24 remove the residual toner adhering to the endless belt 42, thereby cleaning the endless belt 42 for the next cycle of image formation.

The endless belt 42 is manufactured in the same way as the endless belt 22 of the first embodiment, and has the same mechanical characteristics as the endless belt 22. In other words, the endless belt 42 has a Young's modulus in the range of 3.5-7.0 Gpa.

As described above, for an endless belt for use in an image forming apparatus or an electrophotographic color printer based on the intermediate transfer method, the cleaning blade may still be prevented from turning up by selecting the Young's modulus of the endless belt 42 in the range of 3.5-7.0 Gpa. This improves reliability and yield of the endless belt, and prevents the increase in the manufacturing cost of the endless belt.

When the endless belt 42 has a Young's modulus in the range of 3.5-7.0 Gpa, the Young's modulus Y and the thickness T of the endless belt 42 are related such that $$0.0025<P(=Y\times T^3)<0.007$$

This relation is effective in preventing the cleaning blade 24 from turning up and solving the problem of durability due to fracture of the endless belt 42. Thus, a belt excellent in durability and reliability may be obtained.

While the embodiments of the invention have been described in terms of an electrophotographic printer, the invention is not limited to this. The invention may also be applied to other apparatuses including facsimile machines, copying machines, and multifunction peripherals. Although, the embodiments have been described with respect to simplex printers, the invention is not limited to this. The invention may also applicable to duplex printers. The invention may also be applied in a variety of forms including endless belts such as a photoconductive belt, a fixing belt unit, and a transport belt.

What is claimed is:

1. A belt unit, comprising:

an endless belt having a Young's modulus in the range of $3.5\leqq Y\leqq 7.0$, where Y is the Young's modulus in gigapascals;

a plurality of rollers about which said endless belt is disposed and runs; and a cleaning member that removes deposits from a surface of said endless belt;

wherein said endless belt has a thickness such that $0.0025\leqq Y\times T^3\leqq 0.007$, where Y is the Young's modulus in gigapascals and T is the thickness in millimeters.

2. The belt unit according to claim 1, wherein said cleaning member is in pressure contact with said belt and removes the deposits.

3. The belt unit according to claim 1, wherein said cleaning member is in the shape of a blade.

4. The belt unit according to claim 1, wherein said endless belt is formed of a resin material.

5. The belt unit according to claim 1, wherein said endless belt is formed of a polyamide-imide.

6. A transfer unit, comprising:

an endless belt having a Young's modulus in the range of $3.5 \leqq Y \leqq 7.0$, where Y is the Young's modulus in gigapascals;

at least two rollers about which said endless belt is disposed and runs;

a transfer member positioned between said at least two rollers; and a cleaning member that removes deposits from a surface of said endless belt;

wherein said endless belt has a thickness such that $0.0025 \leqq Y \times T^3 \leqq 0.007$, where Y is the Young's modulus in gigapascals and T is the thickness in millimeters.

7. The transfer unit according to claim 6, wherein said cleaning member is in pressure contact with said belt and removes the deposits.

8. The transfer unit according to claim 6, wherein said cleaning member is in the shape of a blade.

9. The transfer unit according to claim 6, wherein said endless belt is formed of a resin material.

10. The transfer unit according to claim 6, wherein said endless belt is formed of a polyamide-imide.

11. The transfer unit according to claim 6, wherein said endless belt runs with a recording medium thereon.

12. An image forming apparatus, comprising:

an endless belt having a Young's modulus in the range of $3.5 \leqq Y \leqq 7.0$, where Y is the Young's modulus in gigapascals;

at least two rollers about which said endless belt is disposed and runs; and a cleaning member that removes deposits from a surface of said endless belt;

wherein said endless belt has a thickness such that $0.0025 \leqq Y \times T^3 \leqq 0.007$, where Y is the Young's modulus in gigapascals and T is the thickness in millimeters.

13. The image forming apparatus according to claim 12, wherein said cleaning member is in pressure contact with said belt and removes the deposits.

14. The image forming apparatus according to claim 12, wherein said cleaning member is in the shape of a blade.

15. The image forming apparatus according to claim 12, further comprising a transfer member positioned between said at least two rollers.

* * * * *